US007313908B2

(12) United States Patent
Schuller et al.

(10) Patent No.: US 7,313,908 B2
(45) Date of Patent: Jan. 1, 2008

(54) DISINTEGRATOR WITH IMPROVED CONTOUR

(75) Inventors: Edmund Schuller, Ingolstadt (DE); Josef Schermer, Bergheim-Unterstall (DE)

(73) Assignee: Rieter Ingolstadt Spinnereimaschinenbau AG (DE)

( * ) Notice: Subject to any disclaimer, the term of this patent is extended or adjusted under 35 U.S.C. 154(b) by 0 days.

(21) Appl. No.: 11/271,512

(22) Filed: Nov. 10, 2005

(65) Prior Publication Data

US 2006/0186240 A1 Aug. 24, 2006

(30) Foreign Application Priority Data

Nov. 11, 2004 (DE) ..... 10 2004 054 653

(51) Int. Cl.
*D01H 4/08* (2006.01)
*D01H 4/32* (2006.01)

(52) U.S. Cl. ..... 57/408

(58) Field of Classification Search ..... 57/408; D15/78

See application file for complete search history.

(56) References Cited

U.S. PATENT DOCUMENTS 2,937,413 A * 5/1960 Hollingsworth ..... 19/114
3,419,941 A * 1/1969 Moriwaki ..... 19/234
4,625,367 A * 12/1986 Sole-Leris ..... 19/113
4,858,275 A * 8/1989 Stahlecker et al. ..... 19/97
4,862,688 A * 9/1989 Schmolke ..... 57/408
4,953,264 A 9/1990 Hollingsworth et al.
4,964,195 A * 10/1990 Hollingsworth ..... 19/114
5,581,848 A * 12/1996 Egerer ..... 19/114
5,642,611 A * 7/1997 Stahlecker ..... 57/408
5,755,012 A * 5/1998 Hollingsworth ..... 19/114
D445,433 S * 7/2001 Hollingsworth ..... D15/78
6,336,257 B1 * 1/2002 Lang ..... 19/114
2004/0010890 A1 * 1/2004 Maidel et al. ..... 19/98

FOREIGN PATENT DOCUMENTS

DE 37 23872 A1 7/1987
DE 10 2004 054 653 A1 5/2006

OTHER PUBLICATIONS

German Search Report.
European Search Report.

* cited by examiner

*Primary Examiner*—Shaun R. Hurley
(74) *Attorney, Agent, or Firm*—Dority & Manning, P.A.

(57) ABSTRACT

A disintegrator apparatus for textile machines is provided that includes a plurality of teeth at a tooth spacing ($L_Z$) of no greater than about 20 mm and preferably less than about 12 mm. The teeth generally include two sections. A first section is located at a tooth apex and exhibits a positive or at least a vertical forward rake ($W_B$). A second section is at an incline, falling in the direction of movement of the operative equipment. The separation distance between the apex of the tooth and a tangential joining point of the vertical tangent creates a transition zone between the first and second sections and forms a technologically effective tooth height ($H_t$). The ratio of the technologically effective tooth height to the spacing between teeth no greater than about 1.

9 Claims, 2 Drawing Sheets

DISINTEGRATOR WITH IMPROVED CONTOUR

TECHNICAL FIELD OF THE INVENTION

The present invention concerns a disintegrator for textile machines, especially for spinning machines, such as, for example, open-end or air-nozzle spinning machines, wherein a plurality of teeth is placed on the outer circumference of a disintegrating roll.

BACKGROUND OF THE INVENTION

In the case of modern textile machines, such as, for example, spinning machines, the production of a thread from a fibers requires that these fibers be released from the compaction of the feed material to form individual, free fibers. This step is carried out prior to the subjection of the fibers to the next operation, which could possibly be a spinning procedure to produce a fiber band from which thread can be spun. At this point, partially different requirements are brought to bear on disintegration apparatuses. The reason for this can be attributed to entirely different kinds of fibers, that are to be worked. Additionally, each kind of fiber calls for entirely different work-up conditions. For example, one can mention here the difference between cotton fibers and chemically produced fibers. Both types of fibers possess very differing fiber characteristics, which are necessary to cope with in a disintegrator apparatus. Moreover, cotton fibers are frequently contaminated with foreign materials and carry substances such as shells or sand, which are to be treated in the process without causing disturbances.

In former years, on this account, a multitude of tooth geometries for disintegrator apparatuses were developed, each of which, for example, sought to achieve a universality of application for many materials. That is to say, it was desirable that each disintegrator could work with the greatest number of fiber types. Other tooth geometries were specialized to treat individual types of fibers and were consequently optimized for one fiber type of a narrow range of properties. The result of this was, that these specialty disintegrators, became limited in their usage and for example, were applied either only for natural fibers such as cotton or were exclusively intended for synthetic fibers of the like of viscose or polyester fibers.

Additionally, DE 199 21 965 A1 discloses a fine-tooth equipped disintegrator roll for an open end spinning machine. The height of the teeth clearly exceeds the pitch thereof, and the teeth exhibit a positive, forward angle (hereinafter "forward rake") of inclination from the vertical. For this careful arrangement of the teeth, provision has been made that the allotment of teeth per unit length is at least three times the height of the said teeth and the forward rake is at least 10°. Such toothing, wherein the tooth height could lie under 2 mm, is determined to be a specialty reserved for the working of synthetic fiber materials. The very close spacing of the teeth has the purpose of assuring that the relatively stiff fibers of synthetic material at the entrance of a machine intake fitting properly disengage from the teeth. The fine teeth, placed close to one another, prevent the fibers from penetrating too deeply into the toothing. This allows the fibers to easily release with is a characteristic that is highly desirable in an approach to a spinning machine feed fitting.

The technological characteristics of disintegration apparatuses do not, however, lie only in the size of the teeth in service, but the very geometry thereof has a decisive influence. As an example, under this classification would be included the very important forward rake of individual teeth and the provided, relative speed between the tooth and the fibers. Experience has demonstrated that in particular applications, difficulties can always arise due to the geometry of the tooth. The reason is that certain tooth-geometries have a good result in separating the incoming fibers, but such geometry can also yield individual fibers in an insufficient amount. Conversely, other tooth geometries exhibit a good yield of the disintegrated fibers, but at the same time leave something to be desired as to the breaking up of the incoming fiber band.

Thus, an objective of the present invention is to create a tooth geometry that provides simultaneously a good possibility for disintegration of fiber material and also a satisfactory yield of free fibers after the disintegration procedure ends.

SUMMARY OF THE INVENTION

Objects and advantages of the invention will be set forth in part in the following description, or may be obvious from the description, or may be learned through practice of the invention.

For achieving the above stated purpose, the invented disintegration apparatus can include teeth that are apportioned with a separation distance between them of, at the most, 20 mm, preferably of less than 12 mm. Preferably, each tooth consists of at least two sections. The first section is located at a tooth apex and possesses a positive or at least a perpendicular forward rake. The second section has a declining slant in the direction of movement of the equipment. Further, the separating distance between the apices of the teeth and an joining point of a vertical tangent at the transition zone between the said first and the second sections form a technologically effective tooth height, whereby the ratio between the technologically effective tooth height to the inter-tooth spacing runs not greater than unity (1). In the case of the arrangements intended for the synthetic fibers, these have, for example, technologically effective tooth heights of about 1 mm and a tooth separation of about 4 mm, which has shown itself as being particularly effective. The ratio, computed as above for this arrangement, runs 0.25. The technologically effective tooth heights, which are particularly advantageously put to use, lie predominately in a range between 0.3 and 1.8 mm, preferably about 1 mm.

The invention takes advantage of the fact, that the subdivision of a tooth into two or more sections, enables the accomplishment of the said purpose of the invention as mentioned in the introductory passages. Thus, the first section of the tooth, which section extends itself from apex of the tooth to the base thereof, forms that stretch of distance, to which can be attributed the especially favorable disintegration possibilities of the invented disintegration apparatus. That side of the tooth, which lies forward in the direction of movement, which side might also be called the side of confrontation, stands vertically or is slightly tilted in the forward direction. The more the forward rake is inclined forward, i.e., in the direction of motion, just that much will the forward rake increase in measurement, and just that much more the capability of disintegration of the so disposed teeth improves, for the reason, that under these circumstances, the fibers have a better chance of seizing upon the tooth structure. Contrary to conventional tooth-geometries, wherein the fibers, likewise, do adhere well, the invention also achieves the advantage, that the fibers can easily disengage themselves. Thus, the situation has been, that up to this time, apparatuses were known, wherein the fibers had the capability of dispersing themselves especially well, but this was linked to the disadvantage of the undesirable property of the fiber to subsequently agglomerate within the disintegrator. In the present case, the invention creates an aid by shaping the second section of the tooth in such a manner, that an area exists from half the tooth height down to the base thereof. This second section is thus made as an inclined slide, which declines in the direction of motion of the disintegration apparatus. This said incline, then prevents the fibers from imperviously collecting themselves at the base of the tooth, since they can now inventively slide along for release. In this manner, the disseminated fibers remain largely collected in the upper zone of the tooth and release themselves at the desired position, this being, for example, at an opening to a fiber feed channel. The disintegrating apparatus, in accord with the invention, thus combines the advantage of an especially favorable tooth geometry with the advantage of a an especially favorable releasing tooth geometry.

In the case of an especially favored embodiment of the invention, provision is made, that between the vertical tangents and the second section, an angle of 3° to 60°, preferably 30° to 50° is closed. Inclined surfaces in angular disposition have shown themselves as being especially effective in these areas. It is particularly advantageous if the teeth, in keeping with the invention, are integral with a carrier wire, which in turn is affixed on a disintegrator roll. These so toothed wires can be fabricated from long strands and at that time, be custom adapted.

A particularly favorable dimensioning is established, if the base height of the toothed wire is less than 2.5 mm. The toothed wire consists, generally, of a reasonably long wire base. This means that this wire, at the latest, upon the equipping of the disintegrator roll body, can be bent into a helical coil which is internally commensurate with the outer circumference of the roll. For instance, the said bending can be carried out during mounting or even in a preliminary step of manufacture, such as prior to a hardening process. Experience has shown that toothed wiring with a base height of less than 2.5 mm is still easily shaped, without, for example, the occurrence of fissures or breaks, which would cause extreme damage to the finished toothed wire. Especially, toothed wires with base heights in the range of 1.5 to 2.4 mm have functioned in many applications without operational problems and have given evidence of satisfactory structural strength.

For the determination of an especially functional tooth contour, advantage has been shown of satisfactory performance, when, in the case of the disintegrator apparatus, the ratio of technologically effective tooth-height to the base height lies between 0.2 and 1.5, or better, between 0.7 and 1. If one employs, for example, a technologically effective tooth-height of 1 mm and a base height of 1.8 mm, then the result provides a ratio of 0.55.

Moreover, the tooth contour has shown itself as advantageous for the capability of disintegration, when the angle of forward rake lies within a range of 0° to 10°.

In the following, the disintegrating rolls, proposed by the invention, the toothed wire and the equipping therewith, characterize themselves throughout, in that the therewith associated tooth-contour is in accord with the previously described embodiment forms. In accord therewith, for these components, the same advantages may be accorded thereto, as for the foregoing, described disintegrating apparatus.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

In FIG. 1 is presented a profile of a section of an exemplary embodiment of an invented toothed wire. On the upper side of the toothed wire 1 are arranged four teeth 2. The teeth 2 are respectively pitched at a separating distance from one another by the distance $L_Z$. The provided direction of motion of the toothed wire 1 is indicated to be in the direction of the arrow 3, i.e., to the right of the drawing. The teeth 2 show a tooth height $H_Z$. which extends itself from the top of the base 4 up to the apex 5 of the tooth. The back side of the tooth 2 is formed by a tooth-back 6, which inclines at an angle of 45°. The forward side of the tooth 2 is subdivided into two sections, whereby the first section is formed by the forward rake inclination 7 and the second section consists of the incline 8. All sections of the tooth contour, that is to say, the tooth back 6, the forward rake 7, the incline 8 and the base of the tooth 4 coalesce into one another and are bound together individually by radii of different lengths. On a rounding 9 (FIG. 1), between the forward rake area 7 and the incline 8 is a vertical tangent 10. The touching point thereof plus the rounding 9 form the underside of a effective tooth height lies on the apex 5. Between the vertical tangent 10 and the incline 8 is opened an angle $W_S$. For this exemplary embodiment, angle $W_s$ is shown about 45°. The forward facing, confronting surface 7 is, on its own, has a forward rake angle $W_B$ relative to a vertical 11. The forward rake angle $W_B$ in the present FIG. 1, is chosen as positive, so that the tooth apex 5 projects into the direction of motion. For this exemplary embodiment, a positive forward rake of about 7° is shown.

FIG. 2 illustrates an enlarged view of a tooth 2 of the toothed wire 1 from FIG. 1. The enlarged version demonstrates with particular clarity the positioning of the technologically effective tooth height $H_t$. This dimension extends itself from the apex 5 to that tangent point where vertical line 10 fares into the rounding 9. The incline 8 extends from the same tangential, joining point downward to the foot 4 of the tooth for height $H_s$. The base height $H_F$ runs from the foot 4 of the tooth again downwards to a bottom edge 12 of the toothed wire 1. The height $H_G$ extends itself from a side edge 13 down to the bottom edge 12 and is also the height of intervening valleys between the eventually roll-wound tooth rows. The base height $H_F$ of the toothed wire, designed according to the present invention, should not exceed 2.5 mm. Preferably, the base height $H_F$ is selected within a range of about 1.5 to 2.2 mm. The height $H_G$ is favorably set within the limits of about 1.0 and 1.7 mm. In almost all instances, it is also sufficient to choose a technologically effective tooth height $H_t$ which would lie in the range of about 0.5 to 1.5 mm. In exceptional cases, the technologically effective tooth height $H_t$, however, can be selected above or below these given limits.

Figure 1:
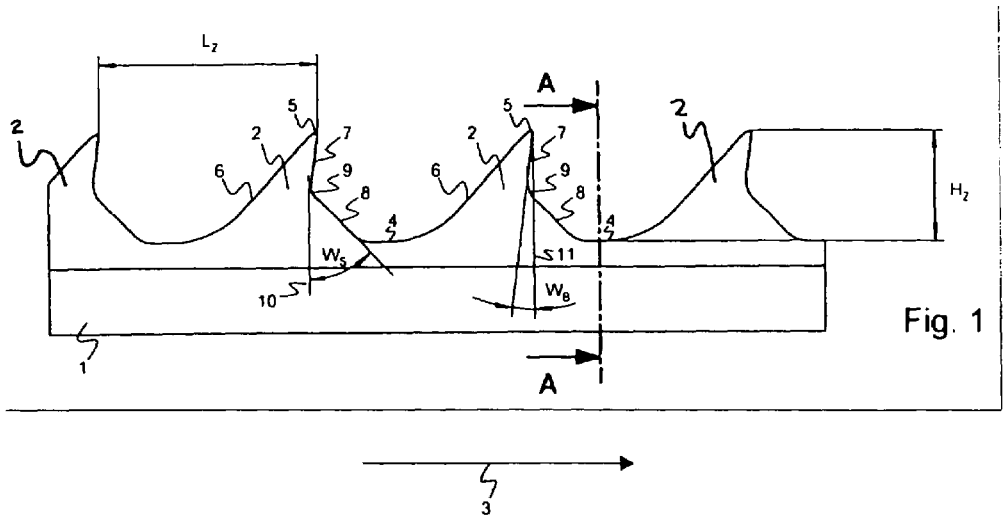
FIG. 1 is a profile view of a section of an exemplary embodiment of an invented toothed wire.
Figure 2:
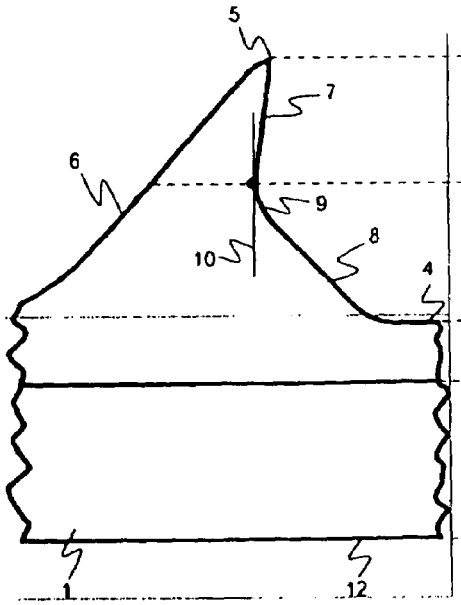
FIG. 2 is an enlarged presentation of a single tooth of the invented toothed wire of FIG. 1
Figure 3:
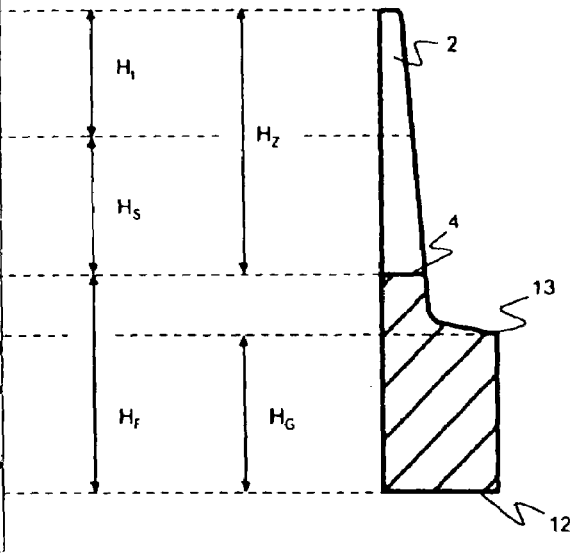
FIG. 3 is a sectional view along the line A-A through the invented toothed wire of FIG. 1.

Finally, FIG. 3 shows a sectional cut through the invented toothed wire in accord with the sectional line A-A of FIG. 1. It is recognizable in this FIG. 3, that the left side of the toothed wire is a vertical plane, while, conversely, the right side of the tooth is angular in formation, so that the tooth 2 tapers upward. This is a possible technical embodiment shape, as this is frequently chosen in the stamping procedure of wire manufacture for toothed wires. Along with this shape, for example, other symmetric shape forms of the tooth longitudinal profile can be used within the framework of the invention. Also, the underside of the of the said toothing valley, which rises initially from an angle from the edge 13 in the direction of the tooth 2, can optionally also be formed in a horizontal manner while still obtaining the effects of the invention.

Moreover, the present invention is not limited to the above-described exemplary embodiment example. There are many more alternatives of the invention possible within the limits of the patent claims. For example, it is possible that within the disclosed value areas, a multitude of different contours can be conceived, which, all together exhibit the advantages of the invention and so fall within the scope of the invention. Beyond this, the invention is uniformly advantageous on both rings of invented toothing as well as on the described toothed wires.

The invention claimed is:

1. A disintegration apparatus for textile machines, including open end spinning machines, the apparatus defining longitudinal, transverse, and clockwise directions, the apparatus comprising:

a plurality of teeth located upon the apparatus and connected along the longitudinal direction with a predetermined tooth spacing $L_z$, each of said plurality of teeth having an apex and a base, and defining a first section facing along the longitudinal direction of motion and positioned contiguous to said apex, said first section being positioned at a predetermined angle $W_B$ from the transverse direction, wherein said angle $W_B$ as measured in the clockwise direction is greater than, or equal to, about 0 degrees; and a second section facing along the longitudinal direction of motion and positioned contiguous to said base, said second section being positioned at a predetermined angle $W_S$ from the transverse direction, wherein said angle $W_S$ as measured in a counter-clockwise direction is greater than 0 degrees, and a rounding section positioned between said first section and said second section;

wherein said rounding section defines a tangential coalescing point as the outermost longitudinal point of said rounding section that is tangent to the transverse direction;

wherein the distance between said tangential coalescing point and said apex defines an effective tooth height $H_t$;

wherein each of said plurality of teeth defines a tooth base having a height $H_F$, and wherein the ratio of said effective tooth height $H_t$ to said height $H_F$ of said tooth base is between about 0.2 and 1.5.

2. A disintegration apparatus for textile machines as in claim 1, wherein a ratio of said effective tooth height $H_t$ to said tooth spacing $L_z$ is less than, or equal to, about 1.

3. A disintegration apparatus for textile machines as in claim 1, wherein each of said plurality of teeth defines a tooth base having a height $H_F$, and wherein the ratio of said effective tooth height $H_t$ to said height $H_F$ of said tooth base is between about 0.7 and 1.0.

4. A disintegration apparatus for textile machines as in claim 1, wherein said predetermined angle $W_S$ as measured in a counter-clockwise direction is in a range of about 3 to 60 degrees.

5. A disintegration apparatus for textile machines as in claim 3, wherein said predetermined angle $W_S$ as measured in a counter-clockwise direction is in a range of about 30 to 50 degrees.

6. A disintegration apparatus for textile machines as in claim 1, where said plurality of teeth are formed upon a carrier wire fastened onto a disintegrator roll body.

7. A disintegration apparatus for textile machines as in claim 1, wherein each of said plurality of teeth defines a tooth base having a height $H_F$ of equal to, or less than, about 2.5 millimeters.

8. A disintegration apparatus for textile machines as in claim 1, wherein said predetermined angle $W_B$ is in a range of about 0 to 10 degrees as measured in the clockwise direction.

9. A disintegration apparatus for textile machines, the apparatus defining longitudinal, transverse, and clockwise directions, the apparatus comprising:

a plurality of teeth located upon a carrier wire of the apparatus, said carrier wire defining substantially linear sections positioned along said wire between each of said plurality of teeth, said plurality of teeth being connected along the longitudinal direction with a predetermined tooth spacing $L_z$, each of said plurality of teeth having an apex and a base, and defining a first section facing along the longitudinal direction of motion and positioned contiguous to said apex, said first section being positioned at a predetermined angle $W_B$ from the transverse direction, wherein said angle $W_B$ as measured in the clockwise direction is greater than, or equal to, about 0 degrees;

a second section facing along the longitudinal direction of motion and positioned contiguous to said base, said second section being positioned at a predetermined angle $W_S$ from the transverse direction, wherein said angle $W_S$ as measured in a counter-clockwise direction is greater than 0 degrees; and a curvilinear section positioned between said first section and said second section; wherein said curvilinear section defines a tangential coalescing point as the outermost longitudinal point of said curvilinear section that is tangent to the transverse direction, wherein the distance between said tangential coalescing point and said apex defines an effective tooth height $H_t$;

wherein a ratio of said effective tooth height $H_t$ to said tooth spacing $L_z$ is less than, or equal to, about 1; and wherein each of said plurality of teeth defines a tooth base having a height $H_F$, and wherein the ratio of said effective tooth height $H_t$ to said height $H_F$ of said tooth base is between about 0.2 and 1.5.

* * * * *